US007448404B2

(12) United States Patent
Samuelsen et al.

(10) Patent No.: US 7,448,404 B2
(45) Date of Patent: Nov. 11, 2008

(54) SEABED LOCATED STORAGE

(75) Inventors: Arild Samuelsen, Tananger (NO); Kåre Breivik, Tau (NO); Ola Ravndal, Sandnes (NO)

(73) Assignee: Navion ASA, Stavanger (NO)

( * ) Notice: Subject to any disclaimer, the term of this patent is extended or adjusted under 35 U.S.C. 154(b) by 473 days.

(21) Appl. No.: 10/532,325

(22) PCT Filed: Oct. 22, 2003

(86) PCT No.: PCT/NO03/00347

§ 371 (c)(1),
(2), (4) Date: Apr. 22, 2005

(87) PCT Pub. No.: WO2004/037681

PCT Pub. Date: May 6, 2004

(65) Prior Publication Data

US 2006/0225633 A1 Oct. 12, 2006

(30) Foreign Application Priority Data

Oct. 23, 2002 (NO) ..... 20025086

(51) Int. Cl.
*B65D 88/78* (2006.01)

(52) U.S. Cl. ..... 137/236.1; 405/210

(58) Field of Classification Search ..... 137/236.1; 405/210, 205, 59; 114/257
See application file for complete search history.

(56) References Cited

U.S. PATENT DOCUMENTS

| | | | | |
|---|---|---|---|---|
| 3,339,512 A | | 9/1967 | Siegel | |
| 3,727,418 A | | 4/1973 | Glazier | |
| 3,835,654 A | * | 9/1974 | Lehanneur | 114/257 |
| 4,190,072 A | | 2/1980 | Fernandez | |
| 4,228,754 A | | 10/1980 | Shibata | |
| 4,662,386 A | * | 5/1987 | Pedersen | 137/236.1 |
| 5,052,856 A | * | 10/1991 | Tek | 405/59 |

* cited by examiner

*Primary Examiner*—Kevin Lee
(74) *Attorney, Agent, or Firm*—Jeffrey Pearce

(57) ABSTRACT

Seabed located storage for crude oil or other fluid, distinguished in that it is comprising a storage section in form of an oil and waterproof cloth formed as a flexible balloon that can be filled with, store and emptied for a storage fluid, a structure section formed as an external casing over the storage section, which structure section is closed in the upper part such that an upward close volume of size at least corresponding to the volume of the storage section is formed, but with openings to the surroundings in the lower part, an anchoring section formed as a substructure between the structure section and the seabed, with means for anchoring to or stable placement on the seabed, and a transfer section comprising pipes and valves for loading and unloading of a storage fluid, arranged in substance exterior to the upper part of the storage.

13 Claims, 3 Drawing Sheets

SEABED LOCATED STORAGE

FIELD OF THE INVENTION

The present invention regards storage at sea of crude oil or other fluid. The invention regards in particular seabed located storage of stabilized crude oil.

The invention is in particular useful in connection with marginal oil fields for which the expenses for a separate pipeline to shore or to another installation cannot be justified or oil fields in their end period of operation, for which costs to investments and maintenance are to be kept at low level. The invention is also beneficial with respect to oil fields for which it is desirable with continuous production and delivery of produced crude oil, and for which it is desirable with a stockpile, for example during temporary shut down of an existing pipe system for delivery of the produced crude oil.

PRIOR ART AND BACKGROUND OF THE INVENTION

Storage of crude oil at sea at present usually takes place at sea surface, on floating storage vessels, in loading buoys with storage capacity, or on the production unit itself in form of a platform or a ship.

Floating production platforms with delivery of the crude oil by use of a tanker is dependent of having storage capacity on the platform or nearby in form of a storage ship or loading buoy with storage capacity, from where the oil can be transported further for example to a land terminal.

Platforms fixed to the seabed have in some embodiments a large fundament that also is comprising storage for produced oil.

The storage for the produced oil is in many respects functioning as ballast, and out of consideration to stability and mechanical loads the oil may have to be replaced with ballast water upon unloading to a tanker. Usually seawater is let into a tank simultaneously as oil is pumped out. By filling of the storage seawater is likewise displaced or pumped out after having passed an oil-water-meter that controls the oil contents of the water before it is discharged. Maximum allowed oil contents of the water to be discharged varies, but is most commonly at present 40 ppm. In connection with storage in the above-mentioned way an undesirable emulsion layer will be formed in the oil load, including oil, water and chemicals. Chemicals are added to keep oil and water better separated. Further, the ingress of relatively small amounts of seawater into the oil load results in undesired salt contents and thereby significantly reduced value of the load. With a water-oil-storage of the above-mentioned type a usual problem is undesired bacterial growth (termed SRB), which in combination with water results in sulphuric acid. It is known that said bacterial growth has resulted in severe problems for tank and pipe systems both on platforms and buoy loading tankers.

The above-mentioned emulsion layer has tendency to gain thickness, and the storage capacity is therefore reduced over time. The emulsion layer can be pumped over to a tanker and transported to a land terminal or refinery to separate water, oil and chemicals and render hazardous components harmless. Said separation and rendering harmless of hazardous components are very expensive and only very few refineries or others undertake such jobs.

A demand exists for providing storage of crude oil or other fluids without the above-mentioned problems. Further, a demand exists for providing a flexible storage for crude oil in such a way that storage units can be transported to where a demand for storage exists, adapted to the actual demand, and allowing production or continued production from marginal fields. A demand also exists for storage without danger for collision with surface vessels, ice or drifting objects.

SUMMARY OF THE INVENTION

With the present invention a subsea located storage is provided for storage of crude oil or other fluid, distinguished in that it is comprising a storage section in form of an oil and waterproof cloth formed as a flexible balloon that can be filled with, store and emptied for a storage fluid, a structure section formed as an external casing over the storage section, which structure section is closed in the upper part such that an upward close volume of size at least corresponding with the storage section volume is formed, but with openings to the surroundings in the lower part, an anchoring section formed as a substructure between the structure section and the seabed, with means for anchoring to or stable placement on the seabed, and a transfer section comprising pipes and valves for loading and unloading of the storage fluid, arranged in substance exterior to the upper part of the storage.

The objective of the invention is met by using a storage section in form of a cloth that is fabricated to a large flexible balloon that is fastened into a structure made up of ferroconcrete, steel or another feasible material, where the upper part of the structure is closed to the surroundings such that the oil of the storage section can be kept confined if leakage occurs and which structure in the lower part is open and attached to an anchoring section that is keeping the storage fixed to the seabed. Loading and unloading takes place via pipes from a production platform or similar, and risers are arranged from the storage to a buoy loading vessel or similar for disposal of the oil.

All valves, instruments and any pumps in connection to the storage will most preferably be possible to operate remotely from the production platform via hydroacoustic signals, optionally via cables.

An oleometer and a hydroacoustic transponder are most preferably arranged on the storage to give an alarm to the production platform or the ship if oil leakage occurs, such that corrective measures immediately can commence. The oleometer is preferably arranged with connection to a pipe from the upper part of the structure section's closed volume to the unloading pipe from the storage. The pipe with connected oleometer preferably includes a remotely controllable pump to pump oil leaked out into an unloading pipeline. Leaked out oil can optionally be pumped up to the vessel via a separate pipeline.

In top of the structure section connections are most preferably arranged, which can be opened to replace the storage section, for example at leakage, and in addition connections for replacement of modules of the transfer section, for example for maintenance or replacement of valves.

The storage preferably comprises valves that automatically are closed if loading lines, unloading lines or the storage section and transfer section are disconnected from the storage.

The storage according to the invention preferably comprises instrumentation for monitoring the filling volume of the storage section, readable from the surface. Ultrasound based instrumentation is considered feasible.

One or more pumps are preferably integrated into the storage, to ease unloading of oil. However, pumps are not necessarily required, and are therefore not obligatory. The lower specific gravity (15% lower specific gravity) of the oil will together with the capillary effect give a degree of flow or drift of oil upwards. Pumps on the loading vessel can preferably be used, and optionally pumps arranged in the unloading line a little below the sea level, to pump oil up to the storage tanks of the vessel.

With the storage according to the present invention full separation of oil and water is achieved, such that formation of an emulsion layer is avoided and the danger of bacterial growth (SRB) is eliminated. Further, a large degree of flexibility is achieved, which means that the storage can be connected to any type of oil production plant, it can easily be placed and moved to new fields, and the storage is independent of water depths within the depths for which oil production presently and in foreseeable future takes place. The water pressure around the storage helps to give a uniform filling and effective unloading of the storage. The storage can relatively easy be taken up and materials be recirculated to other purposes after expiry of the life period. The storage according to the invention can also be used for gas storage in addition to storage of different liquids, with adaptation of the construction to handle the increased buoyancy.

DRAWINGS

The storage according to the invention is illustrated by drawings, of which:

DETAILED DESCRIPTION

Figure 1:
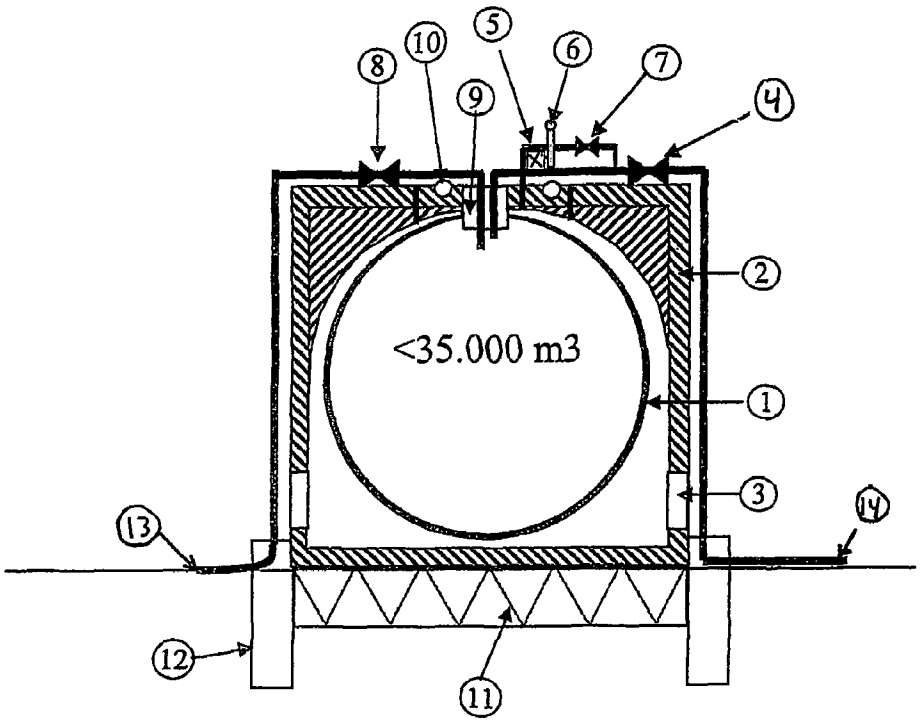
FIG. 1 illustrates an embodiment of the storage according to the invention.

Reference is first made to FIG. 1 illustrating the storage according to the invention. More specific a storage 1 of oil- and waterproof flexible material is illustrated. Further, a structure section 2 is illustrated, which can be made from ferroconcrete, steel or other feasible construction material. Openings 3 for free passage of seawater are provided in the lower part of the structure section. Arranged is a remotely controllable valve 4 between the storage section and the unloading line. In connection to a pipe that is extending between the upper part of the structure section and the unloading pipe it is arranged a remotely controllable valve 7, an oleometer 5 for registration of oil contents between the storage section and the upper part of the structure section, in addition to a transponder 6 for alarm to the platform or optionally to a buoy loading ship at oil leakage. With said pipe leaked out oil can be brought into the unloading pipe with a dedicated pump (not illustrated). Another remotely controllable valve 8 is arranged between the platform and the storage, at the top of the storage. A pipe socket 9 conducts loading oil into the storage section. Pad eyes 10 are arranged for easy connection of lifting equipment in connection with replacement of the storage section. In the lower part of the storage steel skirt 11 is arranged for stabilization of the storage against the seabed, and anchoring 12 in form of suction anchors, piles or similar for fastening to the seabed. A pipe 13, for example a flexible pipe, conducts oil from the production platform to the storage. Another pipe 14, for example a flexible pipe, is arranged to unload oil from the storage to a buoy loading tanker or similar.

Figure 2:
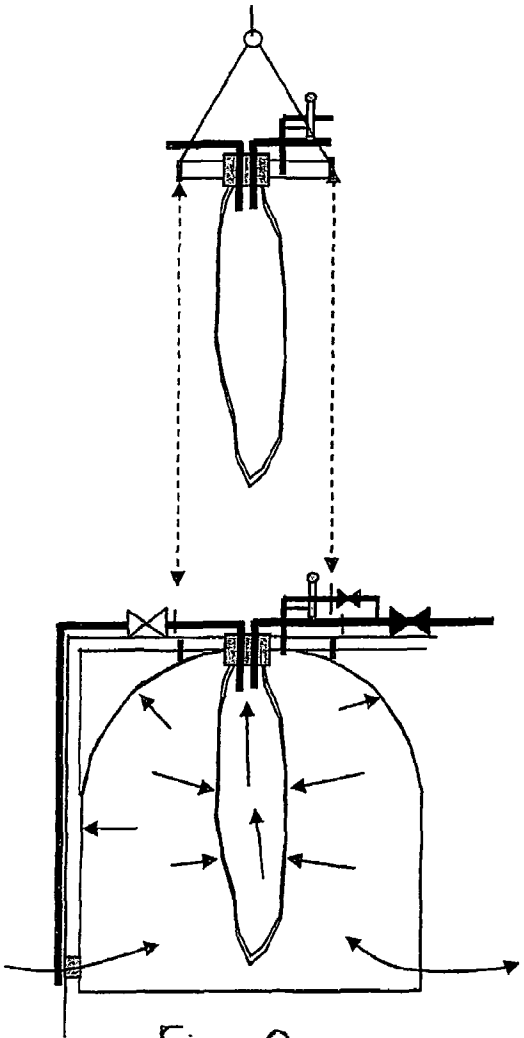
FIG. 2 illustrates the storage according to the invention, with indication of the means to replace the storage section.

On FIG. 2 it is indicated how replacement of the storage section can be undertaken. It is the intension that all equipment that can have demand for maintenance or replacement, such as valves, instruments, pumps and the storage section, can be disconnected from the storage and brought to the surface, either together or as modules of equipment, preferably by use of ROV-operatable bolts, connections and fixing points.

Figure 3:
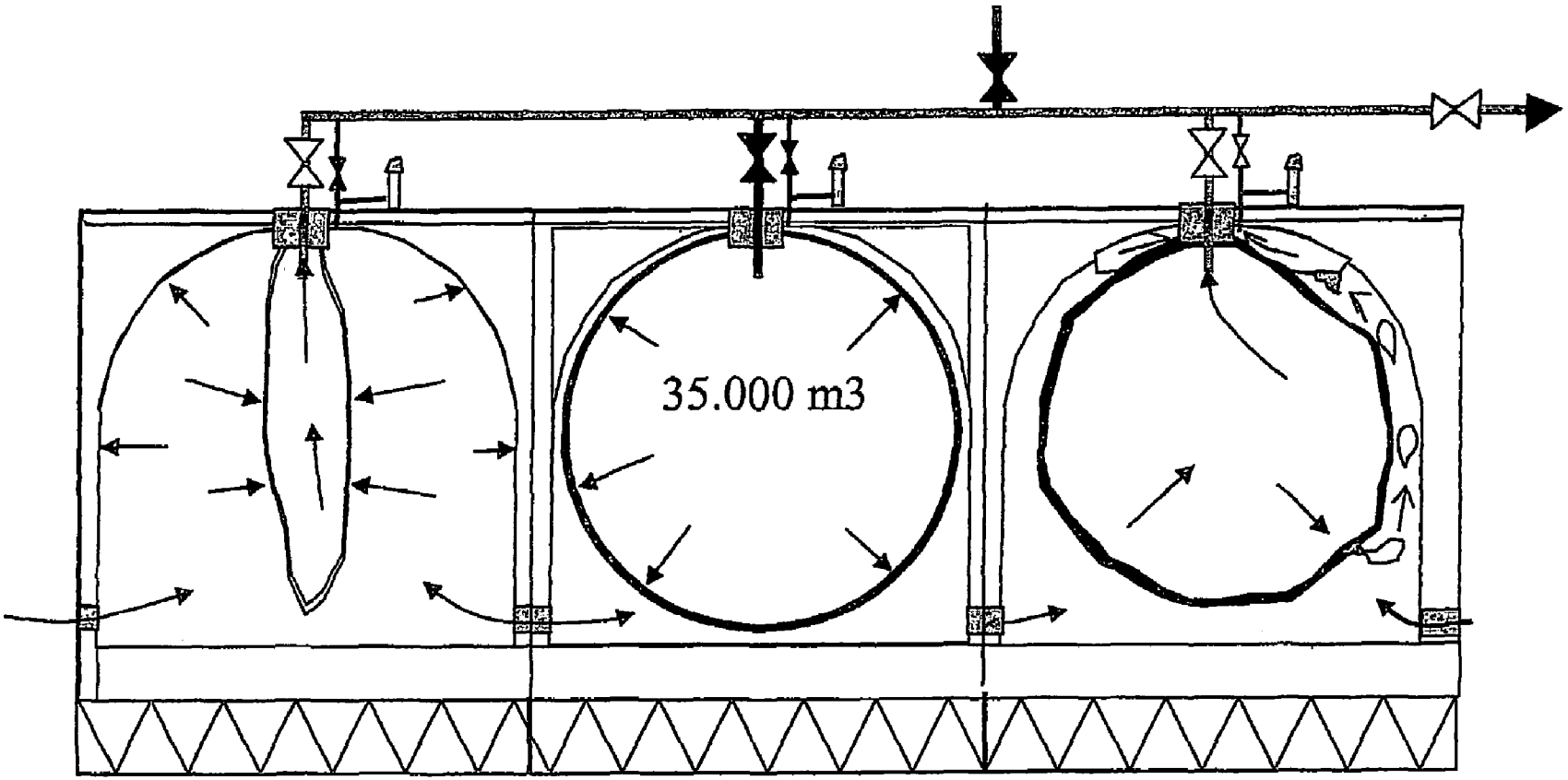
FIG. 3 illustrates an assembly of several storages according to the invention.

FIG. 3 illustrates an assembly of several storages according to the present invention, illustrating from left to right a nearly empty storage section, a full storage section and a storage section with leakage. The transfer section comprises a manifold connected to the platform and also to the loading system. The transfer section per se with valves, pipes and oleometer has a little different construction than illustrated on FIG. 1, however, the functionality is similar.

The storage according to the invention, or assemblies thereof, can be connected to one or more similar or different sources for load and one or more similar or different receivers for load, including subsea production plants and subsea pipeline installations.

Figure 4:
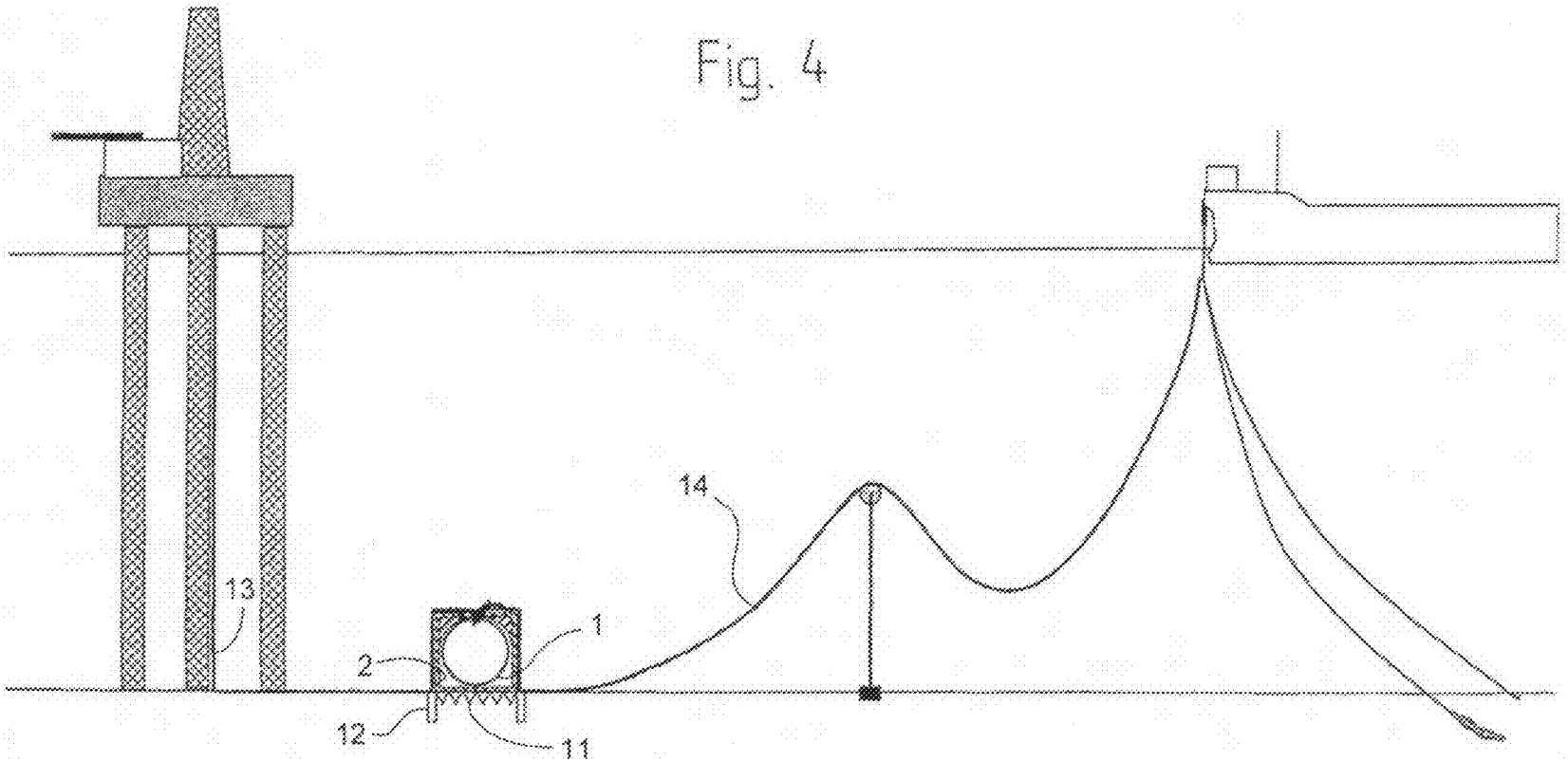
FIG. 4 illustrates a typical arrangement with use of the storage according to the invention.

On FIG. 4 a typical arrangement is illustrated, for which the storage according to the present invention is illustrated in a broader context, located on the seabed connected to a production platform for loading and connected to a tanker for unloading.

The specific construction of the different parts of the storage according to the invention can be varied, provided that the functionality and distinguishing features according to the invention are maintained. The construction materials can be chosen freely under consideration to strength, weight, durability and price. It is considered that the stress during transport and deployment/lifting will be essential for dimensioning. The form of the storage section and the upper part of the struction section can preferably be symmetrical about the vertical axis, taking into account stability, strength and easy filling and unloading. Taking into account the fabrication it can be more preferable with a more square form around the vertical axis, such as for the outer surface of the structure section illustrated on the drawings.

The structure section can preferably be manufactured as a modified embodiment of Unibag from Enviro Team, Oslo, Norway. Unibag is used for storage and transport of water, oil and chemicals. The standard embodiment of the Unibag is prepared from a fabric with the term Protex 092, which is oil- and waterproof and easily weldable with high frequency equipment. More specific the fabric is a woven polyester coated on both sides with a chlorinated cross bound ethylene based inter-polymer alloy. The coating is rubber like but vulcanizing is not required, and softeners are not leaching out as for normal PVC-coated materials. Preferable modifications are comprising, according to demand, increased size, reinforcements and inside or outside inserts, an impermeable jacket or liner of LDPE, PA, PVDF or similar for long term functionality.

The storage volume is limited with respect to strength and ability for handling. Storage volumes up to about 35 000 $m^3$ are considered preferable. This corresponds to a radius of about 20 m if the storage section is a sphere. The storage section can, however, be a half sphere, be pear-shaped, be rectangular or have different form.

In a preferable embodiment of the invention two storage sections, each of about 35 000 $m^3$, are assembled within a common structure section and anchoring section. Dimensions thereby become 35 m×35 m×102 m and with a structure section in steel the weight becomes about 5000 tons. The structure section is thereby considered to comprise 12 mm plates with L300 stiffeners and portal frames (T 2500×600×20×30) each third meter. If the steel is replaced with concrete the weight becomes about 30 000 tons. It is of course possible to assemble several storage sections in one structure section, or to assemble storage modules according to actual demand.

Most preferable suction anchors are used if the seabed conditions are acceptable, else piles are used for anchoring.

The anchoring section can preferably be an integrated part of the structure section. Thereby means for anchoring or stable placement on the seabed are integrated in the structure section, without further components being a part of the anchoring section.

The storage according to the invention can be fabricated at a yard and transported out with a vessel. Transport can be undertaken by filling a sufficient amount of air in the storage section such that the storage or an assembly of several storages can be stably kept floating under towing, with bottom weights to ensure stability.

Deployment of the storage preferably takes place by use of a crane vessel or in at least a crane means. An appropriate volume of air is discharged through hatches, pipes or other outlets such that a weak positive buoyancy is achieved, while the storage or an assembly of several storages are handled stably of the crane. By beginning deployment air is discharged in a controlled way until a weak negative buoyancy is achieved. As the storage is deployed into the sea the air will be compressed and the buoyancy will become more and more negative, which has to be handled entirely by the crane vessel or similar.

Lifting of the storage or an assembly of several storages is also undertaken by use of a crane vessel or similar. If the depth is not too large the storage section can be filled with air to ease lifting, however, not to such extent that uncontrolled positive buoyancy is resulting close to the sea surface.

By using buoyancy elements that are kept at the surface the deployment and lifting can be undertaken without the use of a crane vessel.

The invention claimed is:

1. A storage arrangement for storing a fluid such as crude oil comprising:

at least one storage member formed as a flexible balloon of an oil- and waterproof material having a maximum storage volume into which the fluid is pumped for storage and out of which the fluid is removed for transfer;

an upwardly closed structural section that has an upwardly delimited inner volume that is at least as great as the maximum storage volume and within which the storage member is located; and lower openings;

an anchoring section anchoring the structural section to a seabed;

a transfer section including:

a loading line leading the fluid into the storage member via a loading valve; and an unloading line leading fluid from the storage member via an unloading valve.

2. The storage arrangement according to claim 1, further comprising an oleometer and an acoustic transponder connected for sensing and signaling oil leakage.

3. The storage arrangement according to claim 2, further comprising:

a leakage recovery line located at an upper part of the inner volume of the structural section and leading to the unloading line from the storage member, and recovery pump to pump oil leaked from the storage member, via the recovery line, into the unloading line.

4. The storage arrangement according to claims 1, further comprising a loading line valve and an unloading line valve that close automatically if any of the loading line, unloading line storage member and transfer section are disconnected from the storage arrangement.

5. The storage arrangement according to claim 1, further comprising surface-readable instrumentation for measuring a filling volume of the storage member.

6. The storage arrangement according to claim 1, further comprising at least one integrated auxiliary unloading pump.

7. The storage arrangement according to claims 4, further comprising:

a remotely operable recovery pump to pump oil leaked from the storage member, via a recovery conduit, into the unloading conduit;

at least one integrated auxiliary unloading pump; and instrumentation for measuring a filling volume of the storage member;

in which the loading line and unloading line valves, the recovery and auxiliary unloading pumps and the instrumentation are operable from the surface.

8. The storage arrangement according to claims 1, in which the maximum storage volume of the storage member is about 35 000 $m^3$ or smaller.

9. The storage arrangement according to claim 4, in which:

the structural section has a top part to which the storage member is connected; and the top part is removable from the storage arrangement while the storage arrangement is submerged, the storage member thereby being replaceable and serviceable even when the rest of the storage arrangement is submerged.

10. The storage arrangement according to claim 1, in which the storage member is fabricated from woven polyester coated on each side with a chlorinated cross-bound ethylene based interpolymer alloy, with reinforcements and an internal impermeable liner of LDPE.

11. The storage arrangement according to claim 1, in which a plurality of storage members and respective structural sections, are included within a common main structure.

12. The storage arrangement according to claim 1, in which the anchoring section is an integrated part of the structural section.

13. A storage arrangement for storing a fluid such as crude oil comprising:

at least one storage member formed as a flexible balloon of an oil- and waterproof material having a maximum storage volume into which the fluid is pumped for storage and out of which the fluid is removed for transfer;

an upwardly closed structural section that has an upwardly delimited inner volume that is at least as great as the maximum storage volume and within which the storage member is located; and lower openings;

an anchoring section anchoring the structural section to a seabed;

a transfer section including a loading line leading the fluid into the storage member via a loading valve;

an unloading line leading fluid from the storage member via an unloading valve;

a loading line valve and an unloading line valve that close automatically if any of the loading line, unloading line storage member and transfer section are disconnected from the storage arrangement;

an oleometer and an acoustic transponder provided for sensing and signaling oil leakage;

a leakage recovery line located at an upper part of the inner volume of the structural section and leading to the unloading line from the storage member;

a recovery pump to pump oil leaked from the storage member, via the recovery line, into the unloading line; and surface-readable instrumentation for measuring a filling volume of the storage member.

* * * * *